US012534969B1

(12) United States Patent
Alexander et al.

(10) Patent No.: US 12,534,969 B1
(45) Date of Patent: Jan. 27, 2026

(54) MILLING TOOL, METHOD AND SYSTEM

(71) Applicant: Baker Hughes Oilfield Operations LLC, Houston, TX (US)

(72) Inventors: David Alexander, Houston, TX (US); Knut Inge Dahlberg, Tomball, TX (US); Andrew Ponder, Houston, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 19/057,486

(22) Filed: Feb. 19, 2025

(51) Int. Cl.
*E21B 29/00* (2006.01)

(52) U.S. Cl.
CPC ..... *E21B 29/005* (2013.01)

(58) Field of Classification Search
CPC ..... E21B 29/005; E21B 29/007
See application file for complete search history.

(56) References Cited

U.S. PATENT DOCUMENTS 3,506,077 A * 4/1970 Leathers ..... E21B 10/322 175/267
10,724,339 B2 7/2020 Ponder et al.
2020/0362655 A1* 11/2020 McGarian ..... E21B 29/06

* cited by examiner

*Primary Examiner* — Tara Schimpf
*Assistant Examiner* — Lamia Quaim
(74) *Attorney, Agent, or Firm* — CANTOR COLBURN LLP

(57) ABSTRACT

A milling tool, including an outer housing having a first end and a second end, a blade shifter mandrel movably disposed within the outer housing, a biaser disposed at the first end to bias the shifter mandrel toward the second end, a piston that in response to reverse circulation moves the shifter mandrel toward the first end to compress the biaser, and a blade mounted to the outer housing and in operable contact with the blade shifter mandrel. A method for operating a milling tool, the method including running the milling tool to a target location of a borehole, reverse circulating a fluid in the borehole, biasing the piston with the reverse circulating fluid to deploy the blade. A borehole system, including a borehole in a subsurface formation, a string disposed within the borehole, and a milling tool disposed within or as a part of the string.

12 Claims, 7 Drawing Sheets

MILLING TOOL, METHOD AND SYSTEM

BACKGROUND

In the resource recovery and fluid sequestration industries, there is need to mill sections of a borehole casing or tubular for various reasons. Often, the milling is accompanied by the return of swarf to surface, which must then be appropriately addressed. Some systems have attempted to reduce swarf returning to surface by encouraging the swarf to move downhole instead but this is an incomplete solution.

SUMMARY

An embodiment of a milling tool, including an outer housing having a first end and a second end, the first end being located facing uphole during use and the second end being located facing downhole during use, a blade shifter mandrel movably disposed within the outer housing, a biaser disposed at the first end to bias the shifter mandrel toward the second end, a piston that in response to reverse circulation moves the shifter mandrel toward the first end to compress the biaser, and a blade mounted to the outer housing and in operable contact with the blade shifter mandrel.

An embodiment of a method for operating a milling tool, the method including running the milling tool to a target location of a borehole, reverse circulating a fluid in the borehole, biasing the piston with the reverse circulating fluid to deploy the blade.

An embodiment of a borehole system, including a borehole in a subsurface formation, a string disposed within the borehole, and a milling tool disposed within or as a part of the string.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
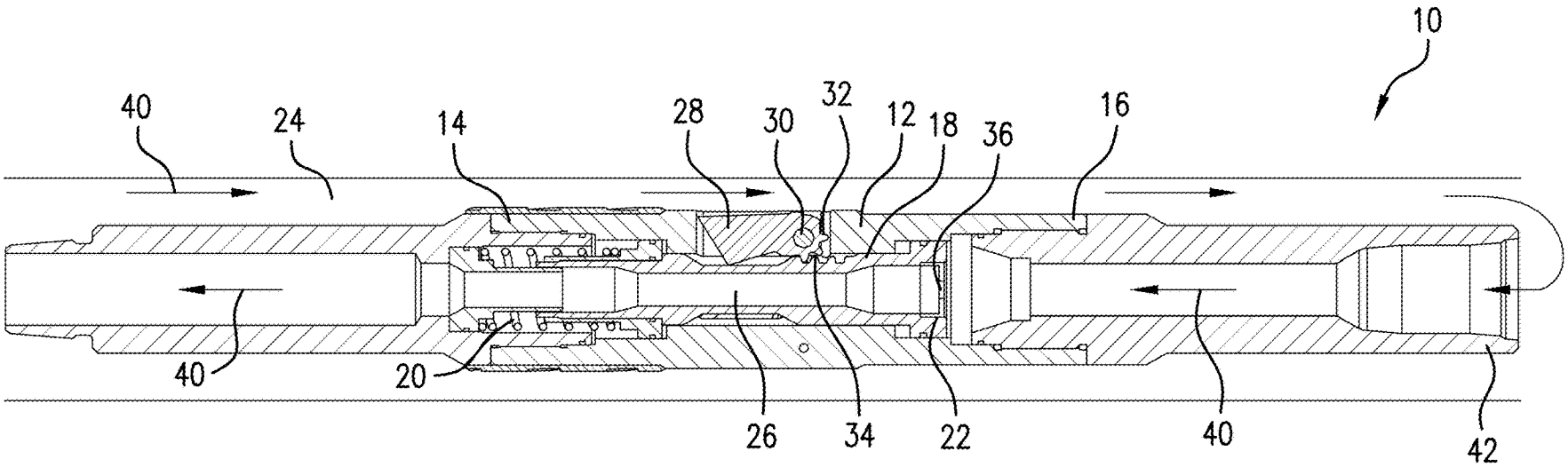
FIG. 1 is a sectional view of a first embodiment of the milling tool in a running position.
Figure 2:
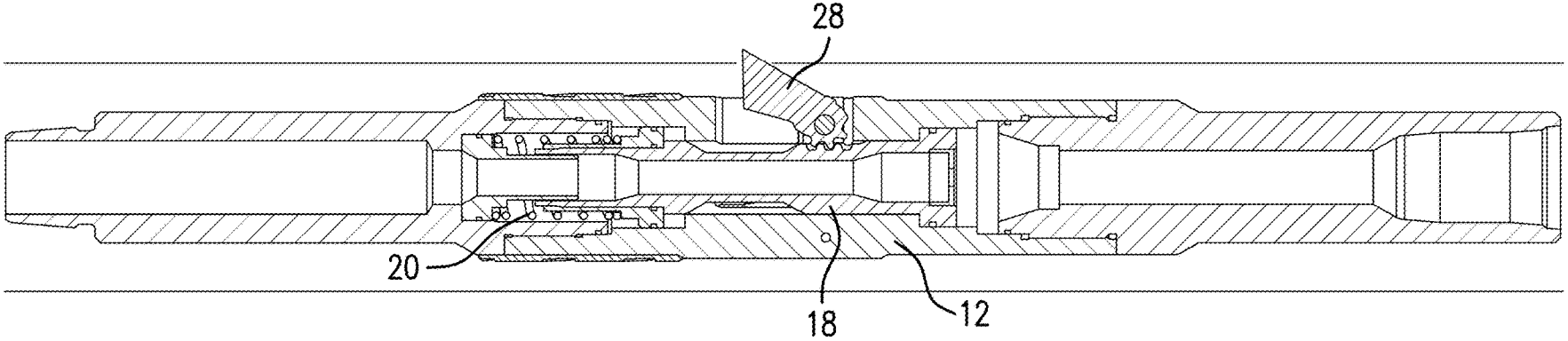
FIG. 2 is a sectional view of the first embodiment of the milling tool in a milling position.
Figure 3:
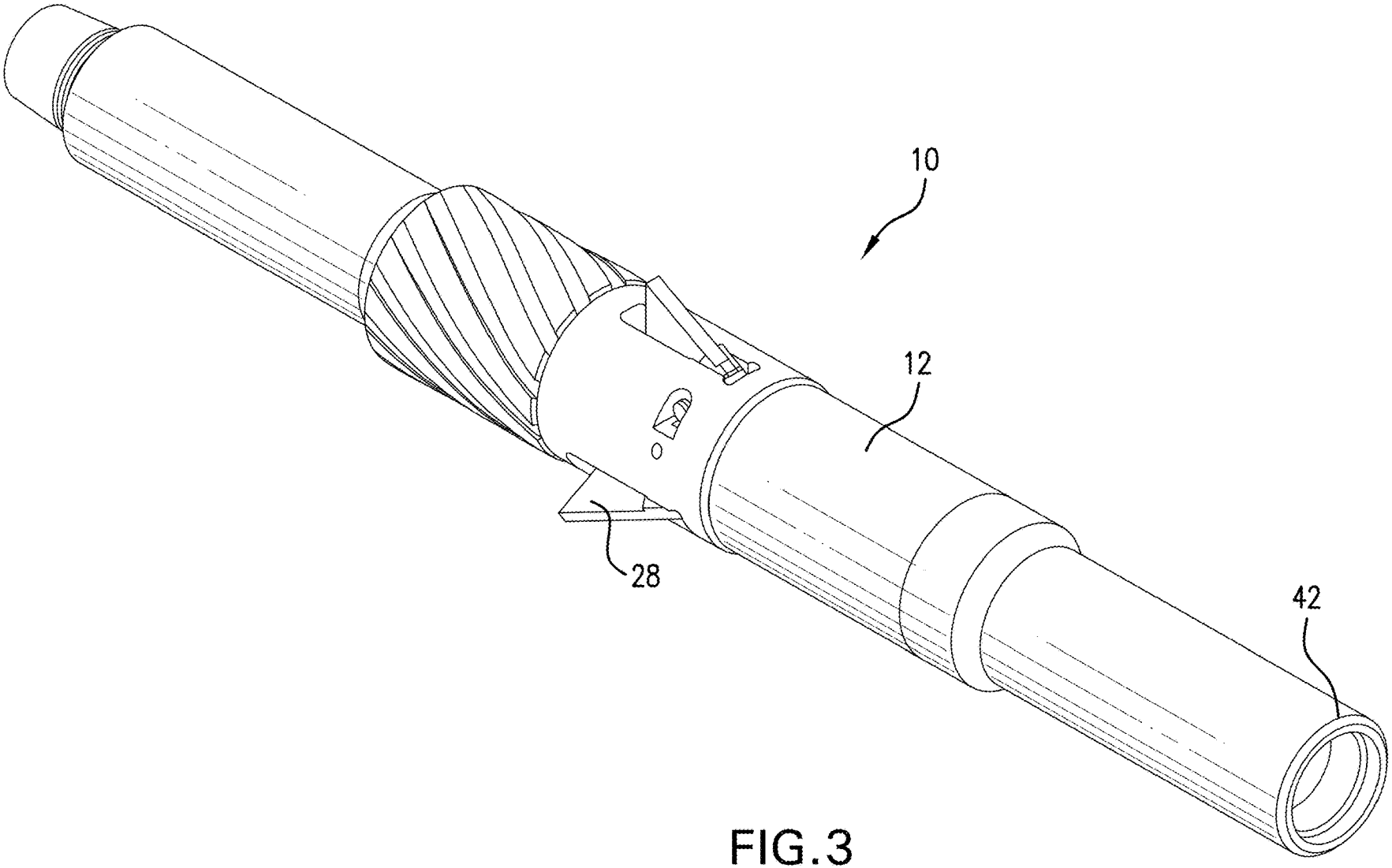
FIG. 3 is a perspective view of the milling tool of FIGS. 1 and 2.
Figure 4:
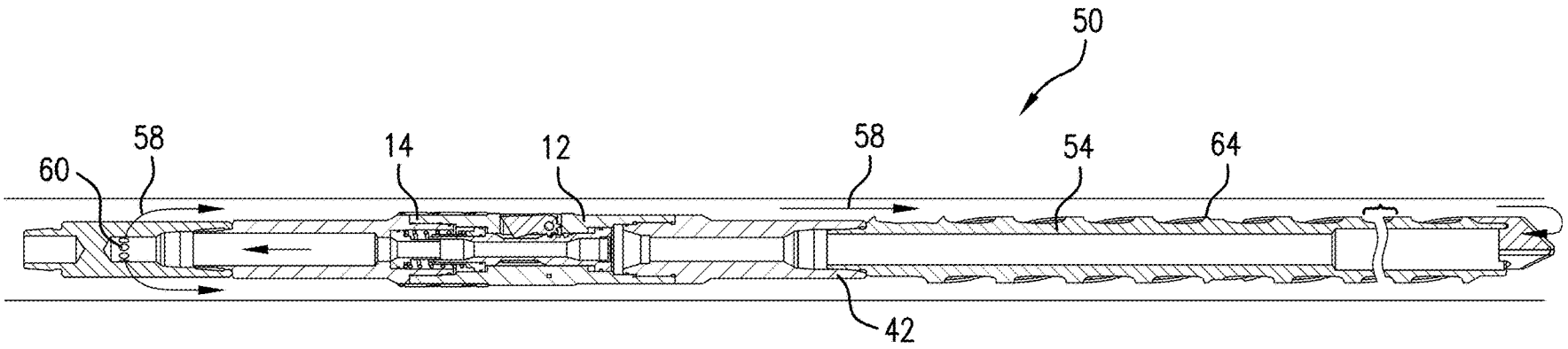
FIG. 4 is a sectional view of a second embodiment of the milling tool in a running position.
Figure 5:
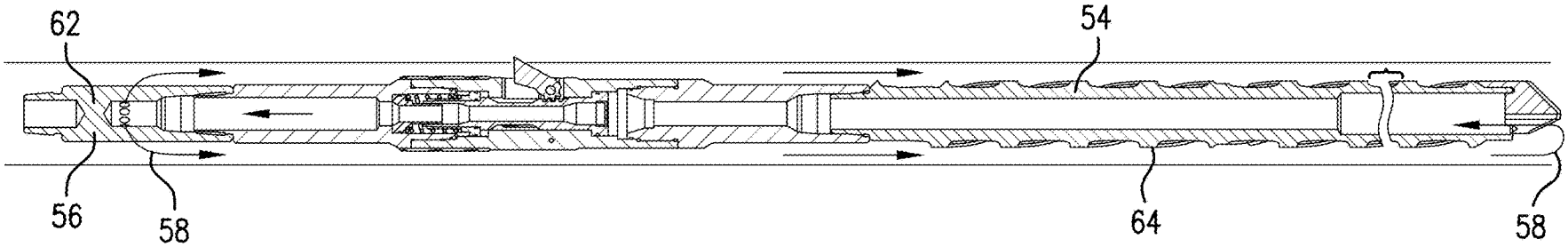
FIG. 5 is a sectional view of the second embodiment of the milling tool in a milling position.
Figure 6:
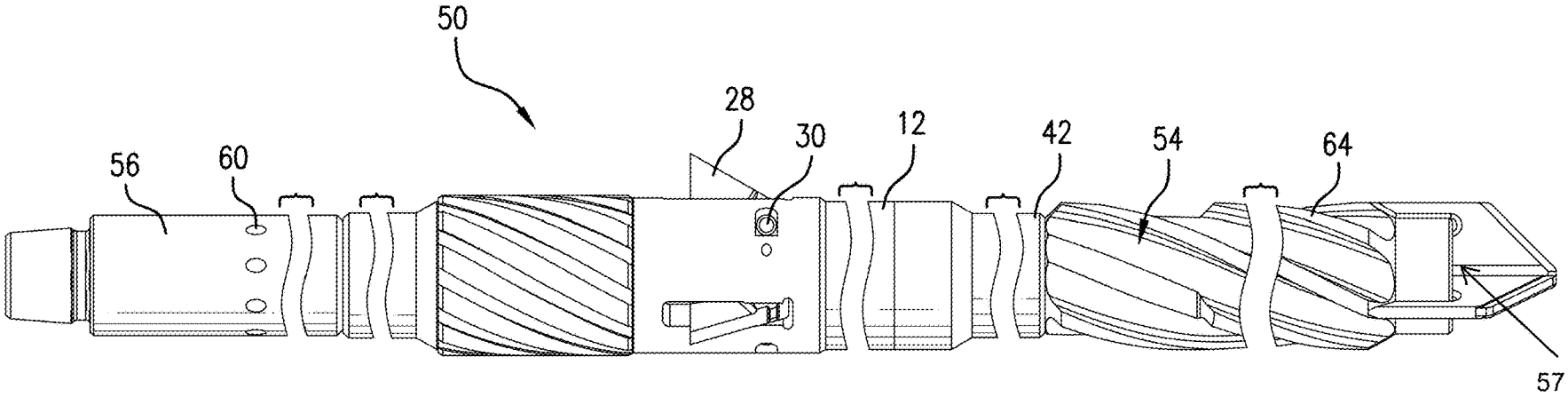
FIG. 6 is a perspective view of the milling tool of FIGS. 3 and 4.

Referring to FIGS. 1-3, a milling tool 10 is illustrated. Tool 10 includes an outer housing 12 having a first end 14 and a second end 16, the first end 14 being located facing uphole during use and the second end 16 being located facing downhole during use. A blade shifter mandrel 18 is disposed within the outer housing 12 in a movable manner.

Specifically, an axial movement of the shifter mandrel 18 is used in conjunction with the ultimate function of the milling tool 10. movably disposed within the outer housing. A biaser 20 is disposed in the outer housing 12 at the first end 14 thereof to bias the shifter mandrel 18 toward the second end 16. In embodiments, the biaser 20 is a compression spring. The spring may be configured as a coil spring, gas spring, or other similar arrangement. A piston 22 is disposed in the outer housing 12 and is responsive to pressure applied thereto via a reverse circulation of fluid about the tool 10. Specifically, reverse circulation refers to fluid being moved or moving in a downhole direction in an annular space 24 about the tool 10 and returning through an inside diameter flow passage 26 of the tool 10. The passage 26 in some embodiments hereof will continue to surface and in some embodiments hereof will continue only to the end 14 where it is ported back to the annulus 24. The reverse circulating fluid, through the mentioned pressure it provides, moves the shifter mandrel 18 toward the first end 14 to compress the biaser 20 and also to actuate a blade 28 articulatingly mounted to the outer housing 12 by a pin 30. The blade 28 includes teeth 32 that are complementary to teeth 34 on the shifter mandrel 18 such that the blade 28 is rotated on the pin 30 when the shifter mandrel 18 is axially displaced relative to the outer housing 12.

Supporting circulation of fluid is an orifice 36 in the piston 22. Without an orifice, there would not be circulation because the fluid would stop at the piston 22. The orifice dimensions are related to the amount of flow desired through the orifice as well as the pressure drop desired across the piston to ensure actuation of the blade 28. As a general proposition, the larger the orifice 36, the greater the flow required to generate the pressure differential to actuate the blade 28. Also, in embodiments, the orifice 36 is square cut, meaning that it is not a nozzle, since the square cut orifice will produce a higher pressure drop due to a more turbulent flow characteristic therethrough.

Reverse circulation may be initiated from surface, from a point uphole of the tool 10 or from a point downhole of the tool 10. These may be from a surface pump, a mud motor type pump or an auger (the term "auger" meaning a cylindrical tool having one or more helically arranged fins to transport both particulate and fluid by transferring momentum to the particulate and or fluid through rotation of the auger, which tool is commercially available from Baker Hughes under family number H15883). Still referring to FIGS. 1 and 2, the tool 10 is configured for reverse circulation from uphole thereof (surface or somewhere in the string above). Arrows 40 show flow direction and path. Due to the turn around in flow at a downhole end 42 of the tool 10, swarf tends to be disentrained from the returning fluid to reduce swarf returns.

Referring to FIGS. 3-6, a similar milling tool 50 includes the housing 12 and internal components described above and further includes an auger 54 connected to the downhole end 42 of the tool 10 and a fluid redirect cap 56 connected to end 14. In this embodiment, tool 50 creates its own reverse circulation loop (see arrows 58) through rotation of the auger 54. It will be appreciated that cap 56 includes ports 60 and a blank 62 preventing fluid from continuing in the uphole direction beyond the cap 56. The rotation may be from surface or from any other motive force, such as a mud motor, an electric motor, etc. operably connected to the auger 54. The auger includes a fin 64 having a lead of about 24 to about 60 inches (axial distance of one revolution of the same fin) with longer lead being related to higher flow rates generated. In embodiments, the fin 64 may be helical and may be configured in a single or multiple pieces. Multiple fins 64 may also be employed as is illustrated. The higher the flow rate, the larger the orifice size as discussed above. In this embodiment, since the reverse circulation flow rate is dictated solely by the auger 54, the orifice 36 must be sized to ensure a sufficient back pressure is generated to overcome spring force of the system to allow actuation of the blade 28 based solely on the auger based flow. The orifice may be configured with a diameter in a range of, for example, about 0.125 inch to about 1.5 inch to produce a specified pressure to stroke the mandrel 26.

A significant benefit of the embodiment of tool 50 is that it is impossible to produce swarf to surface when there are no returns to surface at all. Since the reverse circulation occurs entirely downhole, swarf has nothing within which to be entrained that returns to surface. Additionally, the auger is designed with a large inlet area 57 (larger than a collective area of the ports 60 and larger than an area of annular space 24). This diameter is sized such that the fluid velocity decreases at inlet area 57 to encourage disentrainment of swarf from the fluid stream. This helps prevent transport of swarf back up the passage 26. Further, because there is no need for a tubular structure to run the tool 50, since there is no need for fluid flow from surface thereto or back therefrom, the milling tool 50 may be run on wireline or other non-open ID strings as well as on any conventional string that might have been used for a milling tool.

Figure 7:
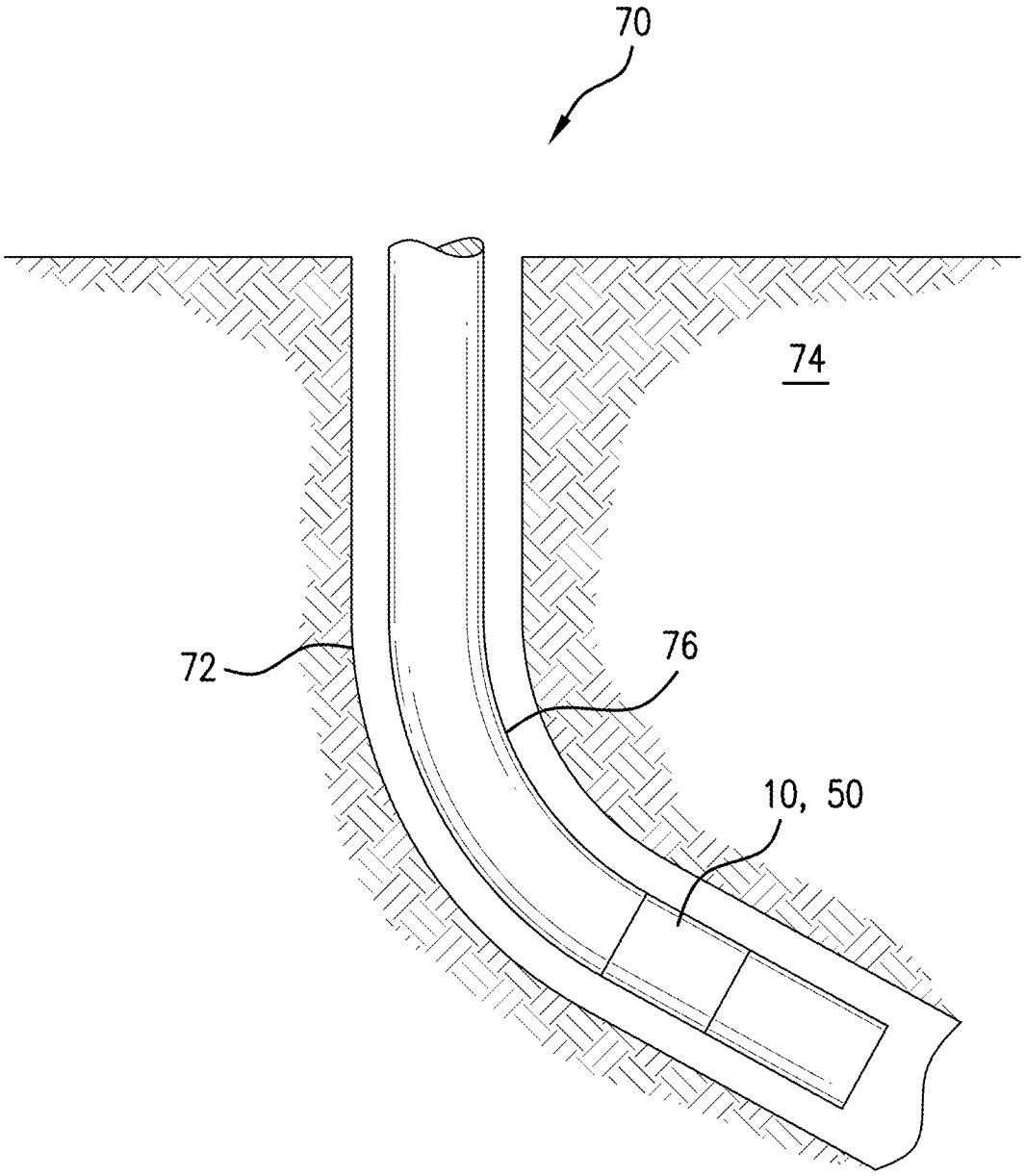
FIG. 7 is a view of a borehole system including a milling tool of FIG. 3 or 6 as disclosed herein.

Referring to FIG. 7, a borehole system 70 is illustrated. The system 70 comprises a borehole 72 in a subsurface formation 74. A string 76 is disposed within the borehole 72. A milling tool 10 or 50 as disclosed herein is disposed within or as a part of the string 76.

Set forth below are some embodiments of the foregoing disclosure:

Embodiment 1: A milling tool, including an outer housing having a first end and a second end, the first end being located facing uphole during use and the second end being located facing downhole during use, a blade shifter mandrel movably disposed within the outer housing, a biaser disposed at the first end to bias the shifter mandrel toward the second end, a piston that in response to reverse circulation moves the shifter mandrel toward the first end to compress the biaser, and a blade mounted to the outer housing and in operable contact with the blade shifter mandrel.

Embodiment 2: The milling tool as in any prior embodiment, further comprising an auger fixedly connected to the outer housing.

Embodiment 3: The milling tool as in any prior embodiment, wherein the auger, having a longitudinal axis, includes a fin having a pitch whose angle relative to the longitudinal axis of the auger is proportional to a diameter of an orifice in the piston.

Embodiment 4: A method for operating a milling tool, the method including running the milling tool as in any prior embodiment to a target location of a borehole, reverse circulating a fluid in the borehole, biasing the piston with the reverse circulating fluid to deploy the blade.

Embodiment 5: The method as in any prior embodiment, wherein the reverse circulating is initiated from a remote location.

Embodiment 6: The method as in any prior embodiment, wherein the remote location is surface.

Embodiment 7: The method as in any prior embodiment, further including rotating the section mill.

Embodiment 8: The method as in any prior embodiment, wherein the milling tool further includes an auger fixedly attached thereto and the reverse circulating is initiated by rotating the auger.

Embodiment 9: A borehole system, including a borehole in a subsurface formation, a string disposed within the borehole, and a milling tool as in any prior embodiment disposed within or as a part of the string.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A milling tool, comprising:

an outer housing having a first end and a second end, the first end being located facing uphole during use and the second end being located facing downhole during use;

a blade shifter mandrel movably disposed within the outer housing;

a biaser disposed at the first end to bias the blade shifter mandrel toward the second end;

a piston disposed at the second end that in response to reverse circulation moves the blade shifter mandrel toward the first end to compress the biaser; and a blade mounted to the outer housing and in operable contact with the blade shifter mandrel, the blade moving to a deployed position during use upon the blade shifter mandrel moving towards the first end.

2. The milling tool as claimed in claim 1, further comprising an auger fixedly connected to the outer housing.

3. The milling tool as claimed in claim 2, wherein the auger, having a longitudinal axis, includes a fin having a pitch whose angle relative to the longitudinal axis of the auger is proportional to a diameter of an orifice in the piston.

4. The milling tool as claimed in claim 1, wherein the piston is disposed at the second end and is configured to respond to a pressure differential across the piston created by a pressure drop in fluid flowing through the piston during use.

5. The milling tool as claimed in claim 4, wherein the piston includes an orifice that is square.

6. The milling tool as claimed in claim 1, wherein the piston is biased in the same direction as the reverse circulated fluid.

7. A method for operating a milling tool, the method comprising:

running the milling tool as claimed in claim 1 to a target location of a borehole;

reverse circulating a fluid in the borehole;

biasing the piston with the reverse circulating fluid to deploy the blade.

8. The method as claimed in claim 7, wherein the reverse circulating is initiated from a remote location.

9. The method as claimed in claim 8, wherein the remote location is surface.

10. The method as claimed in claim 7, further including rotating the section mill.

11. A method for operating a milting tool, the method comprising:

running a milling tool, comprising:

an outer housing having a first end and a second end, the first end being located facing uphole during use and the second end being located facing downhole during use;

a blade shifter mandrel movably disposed within the outer housing;

a biaser disposed at the first end to bias the blade shifter mandrel toward the second end;

a piston that in response to reverse circulation moves the blade shifter mandrel toward the first end to compress the biaser;

a blade mounted to the outer housing and in operable contact with the blade shifter mandrel, and an auger fixedly attached to the milling tool and configured to cause reverse circulation by rotating the auger;

reverse circulating a fluid in the borehole;

biasing the piston with the reverse circulating fluid to deploy the blade.

12. A borehole system, comprising:

a borehole in a subsurface formation;

a string disposed within the borehole; and a milling tool as claimed in claim 1 disposed within or as a part of the string.

* * * * *